US010519954B2

(12) United States Patent
Berning et al.

(10) Patent No.: US 10,519,954 B2
(45) Date of Patent: Dec. 31, 2019

(54) COMPRESSOR WITH OIL MANAGEMENT SYSTEM

(71) Applicant: Emerson Climate Technologies, Inc., Sidney, OH (US)

(72) Inventors: Jeffrey L. Berning, Fort Loramie, OH (US); Robert C. Stover, Versailles, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 171 days.

(21) Appl. No.: 15/604,150

(22) Filed: May 24, 2017

(65) Prior Publication Data

US 2018/0340536 A1 Nov. 29, 2018

(51) Int. Cl.

| | |
|---|---|
| ***F04C 29/02*** | (2006.01) |
| ***F04C 18/02*** | (2006.01) |
| *F04C 23/00* | (2006.01) |

(52) U.S. Cl.

CPC ..... *F04C 29/02* (2013.01); *F04C 18/0215* (2013.01); *F04C 18/0261* (2013.01); *F04C 23/008* (2013.01)

(58) Field of Classification Search

CPC .. F04C 29/02; F04C 18/0215; F04C 18/0292; F04C 29/0007; F04C 29/023; F04C 18/0253

See application file for complete search history.

(56) References Cited

U.S. PATENT DOCUMENTS

| | | | | |
|---|---|---|---|---|
| 5,548,973 | A * | 8/1996 | Komine | C10M 105/36 252/68 |
| 9,239,054 | B2 | 1/2016 | Ignatiev et al. | |
| 2013/0209303 | A1* | 8/2013 | Tsuka | F04C 18/0215 418/55.1 |
| 2015/0139844 | A1 | 5/2015 | Akei et al. | |

FOREIGN PATENT DOCUMENTS

| | | | |
|---|---|---|---|
| CN | 1055527 | C | 8/2000 |
| CN | 1629490 | A | 6/2005 |
| CN | 103429901 | A | 12/2013 |
| CN | 103459850 | A | 12/2013 |

(Continued)

OTHER PUBLICATIONS

Translation of First Office Action dated Apr. 24, 2019 corresponding to Chinese Patent Application No. 201810494380.7, 13 pages.

*Primary Examiner* — Deming Wan

(74) *Attorney, Agent, or Firm* — Harness, Dickey & Pierce, P.L.C.

(57) ABSTRACT

A compressor according to the present disclosure includes a shell, a main bearing housing disposed within the shell, a driveshaft supported by the main bearing housing, a non-orbiting scroll member coupled to the main bearing housing, and an orbiting scroll member rotatably coupled to the driveshaft and meshingly engaged with the non-orbiting scroll member. The non-orbiting scroll member forms a suction pocket and at least one circumferential groove. The orbiting scroll member forms a lubricant passage that delivers lubricant from a lubricant source directly to at least one of the suction pocket and the at least one circumferential groove.

25 Claims, 9 Drawing Sheets

(56) References Cited

FOREIGN PATENT DOCUMENTS

| | | | |
|---|---|---|---|
| CN | 104295498 | A | 1/2015 |
| CN | 104797822 | A | 7/2015 |
| CN | 105464989 | A | 4/2016 |
| CN | 105822546 | A | 8/2016 |
| JP | S62261686 | A | 11/1987 |
| JP | H0381587 | A | 4/1991 |
| JP | 2009174500 | A | 8/2009 |

* cited by examiner

COMPRESSOR WITH OIL MANAGEMENT SYSTEM

FIELD

The present disclosure relates to scroll compressors, and more particularly, to scroll compressors including an oil management system.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Scroll compressors are used in applications such as refrigeration systems, air conditioning systems, and heat pump systems to pressurize and, thus, circulate refrigerant within each system.

A scroll compressor typically includes an orbiting scroll member having an orbiting scroll vane and a non-orbiting scroll member having a non-orbiting scroll vane. As the scroll compressor operates, the orbiting scroll member orbits with respect to a non-orbiting scroll member, causing moving line contacts between flanks of the respective scroll vanes or wraps. In so doing, the orbiting scroll member and the non-orbiting scroll member cooperate to define moving, crescent-shaped pockets of vapor refrigerant. A volume of the fluid pockets decreases as the pockets move toward a center of the scroll members, thereby compressing the vapor refrigerant disposed therein from a suction pressure to a discharge pressure.

During operation, lubrication is provided to many of the moving components of the scroll compressor in an effort to reduce wear, improve performance and, in some instances, to cool one or more components. For example, lubrication in the form of oil may be provided to the orbiting scroll member and to the non-orbiting scroll member such that flanks of the orbiting scroll spiral vane and flanks of the non-orbiting scroll spiral vane are lubricated during operation. Such lubrication may be returned to a sump of the compressor and in so doing may come in contact with a motor of the compressor, thereby cooling the motor to a desired temperature.

While lubrication is typically used in a scroll compressor to improve performance and longevity, such lubrication is typically separated from vapor refrigerant located within the compressor to improve compressor performance and efficiency.

SUMMARY

A first compressor according to the present disclosure includes a shell, a main bearing housing disposed within the shell, a driveshaft supported by the main bearing housing, a non-orbiting scroll member coupled to the main bearing housing, and an orbiting scroll member rotatably coupled to the driveshaft and meshingly engaged with the non-orbiting scroll member. The non-orbiting scroll member forms a suction pocket and at least one circumferential groove. The orbiting scroll member forms a lubricant passage that delivers lubricant from a lubricant source directly to at least one of the suction pocket and the at least one circumferential groove.

In one aspect, the lubricant passage in the orbiting scroll member delivers lubricant from the lubricant source directly to both the suction pocket and the at least one circumferential groove in the non-orbiting scroll member at different times.

In one aspect, the lubricant passage in the orbiting scroll member includes an inlet end in fluid communication with the lubricant source and an outlet end in selective fluid communication with the suction pocket and the at least one circumferential groove in the non-orbiting scroll member.

In one aspect, as the orbiting scroll member orbits relative to the non-orbiting scroll member, the outlet end of the lubricant passage moves to a first position in which the outlet end is in fluid communication with the suction pocket and a second position in which the outlet end is in fluid communication with the at least one circumferential groove.

In one aspect, the at least one circumferential groove includes an outer circumferential groove and an inner circumferential groove disposed radially inward of the outer circumferential grooves, and the outlet end of the lubricant passage is in selective fluid communication with the suction pocket, the outer circumferential groove, and the inner circumferential groove.

In one aspect, as the orbiting scroll member orbits relative to the non-orbiting scroll member, the outlet end of the lubricant passage moves to a first position in which the outlet end is in fluid communication with the suction pocket, a second position in which the outlet end is in fluid communication with the outer circumferential groove, and a third position in which the outlet end is in fluid communication with the inner circumferential groove.

In one aspect, the lubricant passage includes a first axial channel, a second axial channel, and a radial channel. The first axial channel extends axially from the inlet end of the lubricant passage to the radial channel. The radial channel extends radially from the first axial channel to the second axial channel. The second axial channel extends axially from the radial channel to the outlet end of the lubricant passage.

In one aspect, the orbiting scroll member includes a baseplate and a vane projecting axially from the baseplate, and the lubricant passage extends through the baseplate of the orbiting scroll member to deliver lubricant from the lubricant source directly to the at least one circumferential groove in the non-orbiting scroll member.

In one aspect, the orbiting scroll member further includes a hub projecting from the baseplate in an opposite direction than the vane, and the driveshaft has a first end disposed within the hub, a second end opposite of the first end, and an axial bore extending through the driveshaft from the second end to the first end. The lubricant source is lubricant delivered through the axial bore in the driveshaft to a lubricant supply area disposed between the first end of the driveshaft and the hub.

In one aspect, the non-orbiting scroll member includes a baseplate and a vane projecting axially from the baseplate. The vane of the orbiting scroll member meshingly engages the vane of the non-orbiting scroll member to form a compression pocket. The at least one circumferential groove is disposed radially outward relative to the vane of the non-orbiting scroll member.

In one aspect, the lubricant passage in the orbiting scroll member delivers lubricant from the lubricant source directly to the suction pocket. The suction pocket is in fluid communication with a suction gas inlet fitting extending through the shell of the compressor.

A second compressor according to the present disclosure includes a shell, a main bearing housing disposed within the shell, a driveshaft supported by the main bearing housing, a non-orbiting scroll member coupled to the main bearing housing, and an orbiting scroll member rotatably coupled to the driveshaft and cooperating with the non-orbiting scroll member to form a compression pocket. The non-orbiting scroll member forms a suction pocket and at least one circumferential groove. The orbiting scroll member forms an injection port in fluid communication with a lubricant source. As the orbiting scroll member orbits relative to the non-orbiting scroll member, the injection port moves to a first position in which the injection port delivers lubricant to the suction pocket and to a second position in which the injection port delivers lubricant to the at least one circumferential groove.

In one aspect, the injection port delivers lubricant directly to the suction pocket when the injection port is in the first position.

In one aspect, the injection port delivers lubricant directly to the at least one circumferential groove when the injection port is in the second position.

In one aspect, the at least one circumferential groove has a radial dimension, an axial dimension, and a circumferential dimension that is greater than the radial dimension and the axial dimension.

In one aspect, the non-orbiting scroll member includes a baseplate and a vane projecting from the baseplate. The baseplate has an outer radial surface extending around an outer perimeter of the baseplate, an inner radial surface defining a pocket in which the vane is disposed, and a thrust surface disposed between the inner and outer radial surfaces and facing the orbiting scroll member. The at least one circumferential groove is formed in the thrust surface.

In one aspect, the suction pocket is disposed between the inner radial surface of the baseplate and an outermost radial surface of the vane and extends axially through the baseplate.

In one aspect, the at least one circumferential groove includes an outer circumferential groove and an inner circumferential groove disposed radially inward of the outer circumferential groove. The injection port delivers lubricant directly to the outer circumferential groove when the injection port is in the second position. The injection port moves to a third position as the orbiting scroll member orbits relative to the non-orbiting scroll member. The injection port delivers lubricant directly to the inner circumferential groove when the injection port is in the third position.

In one aspect, the outer circumferential groove extends completely around a circumference of the non-orbiting scroll member.

In one aspect, the inner circumferential groove extends around at least one-third of the circumference of the non-orbiting scroll member and includes a connection portion that extends radially outward and intersects the outer circumferential groove.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Figure 1:
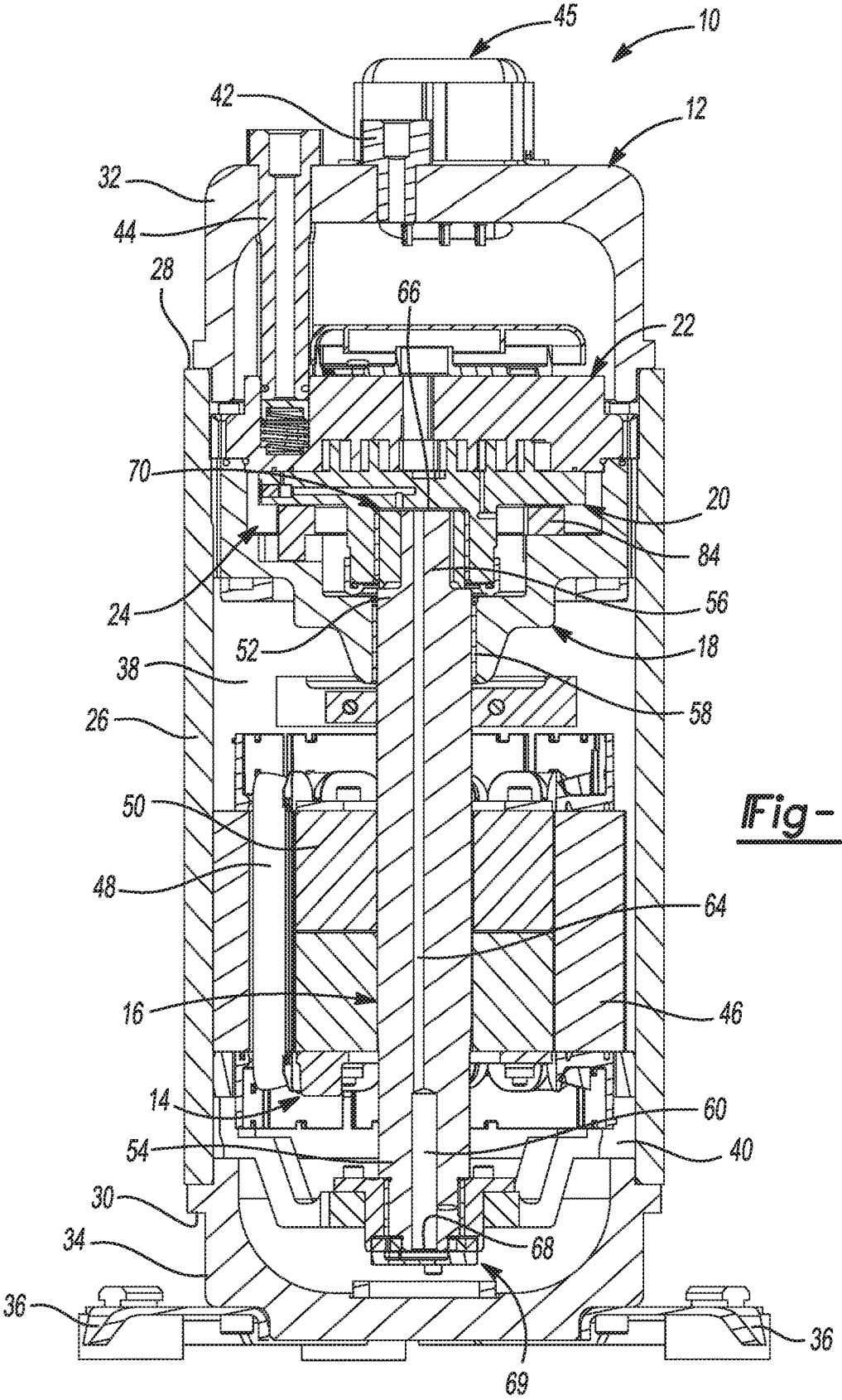
FIG. 1 is a cross-sectional view of a compressor in accordance with the present disclosure.
Figure 2:
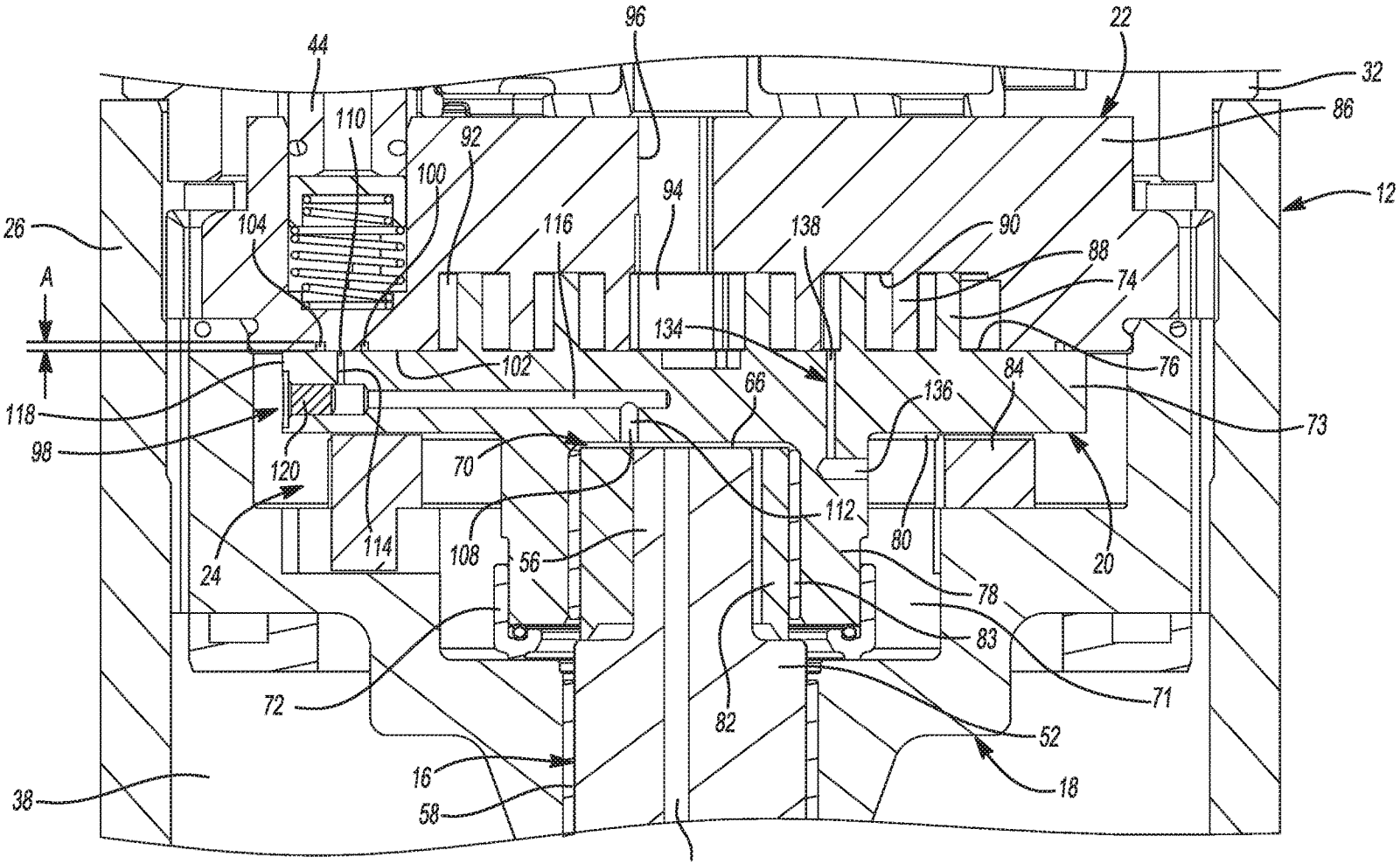
FIG. 2 is a cross-sectional view of a portion of the compressor of FIG. 1 including at least portions of a non-orbiting scroll member, an orbiting scroll member, and a driveshaft that cooperate to form an oil management system.

Referring to FIGS. 1 and 2, a compressor 10 includes a hermetic shell 12, a motor 14, a driveshaft 16, a main bearing housing 18, an orbiting scroll member 20, a non-orbiting scroll member 22, and a lubrication system 24. The shell 12 includes a cylindrical portion 26 having an upper end 28 and a lower end 30, a cap 32 welded to the upper end 28, and a base 34 welded to the lower end 30 and having a plurality of feet 36. The cap 32 and the base 34 are fitted to the cylindrical portion 26 of the shell 12 such that an interior volume 38 of the compressor 10 is defined. Lubricant (e.g., oil) may be stored within a bottom portion 40 of the shell 12 for lubricating the moving parts of the compressor 10, as will be described below. The cap 32 is provided with a discharge fitting 42 in fluid communication with the interior volume 38 of the compressor 10 and a suction gas inlet fitting 44 in fluid communication with the suction side (or low side) of a climate control system in which the compressor 10 is included. An electrical enclosure 45 may be attached to the cap 32 and may support a portion of an electrical protection and control system (not shown) therein.

The driveshaft 16 is rotatably driven by the motor 14 relative to the shell 12. The motor 14 includes a stator 46 fixedly supported by the shell 12, windings 48 passing therethrough, and a rotor 50 press-fit on the driveshaft 16. The motor 14 and associated stator 46, windings 48, and rotor 50 cooperate to drive the driveshaft 16 relative to the shell 12 to compress a fluid.

The driveshaft 16 has a first end 52 and a second end 54 opposite of the first end 52, and the driveshaft 16 may include an eccentric pin 56 mounted to, or integrally formed with, the first end 52 thereof. A portion of the driveshaft 16 is supported by a main bearing 58 provided in the main bearing housing 18. The driveshaft 16 may include a central bore 60 formed at the second end 54 thereof and an eccentric bore 64 extending upwardly from the central bore 60 to an end surface 66 of the eccentric pin 56. An end portion 68 of the central bore 60 may be immersed in the lubricant at the bottom portion 40 of the shell 12 of the compressor 10 (FIG. 1) such that lubricant can be pumped from the bottom portion 40, and up through the end surface 66 of the eccentric pin 56.

Under the action of the centrifugal force generated by the rotation of the driveshaft 16 and/or an oil pump 69 attached to the end portion 68 of the driveshaft 16, the lubricant may traverse the central bore 60 from the end portion 68 to the end surface 66 of the eccentric pin 56. Lubricant exiting the end surface 66 of the eccentric pin 56 enters a lubricant source or lubricant supply area 70 disposed between the eccentric pin 56 and the orbiting scroll member 20 and between the main bearing housing 18 and the orbiting scroll member 20, lubricating the rotational joints and sliding surfaces therebetween. As will be described below, the lubricant supply area 70 may also supply lubricant to the lubrication system 24.

An intermediate chamber 71 is formed between the orbiting scroll member 20 and the main bearing housing 18. An annular seal 72 separates the intermediate chamber 71 from the lubricant supply area 70. The intermediate chamber 71 functions to provide an axial biasing force that keeps the orbiting and non-orbiting scroll members 20 and 22 in contact with each other during operation of the compressor 10. The pressure in the intermediate chamber 71 is at an intermediate pressure that is greater than the suction gas pressure in the low-pressure zone 92 and less than the discharge gas pressure in a centrally disposed discharge passage 96 provided in the non-orbiting scroll member 22.

The orbiting scroll member 20 may be disposed within, and axially supported by, the main bearing housing 18. As best shown in FIG. 2, the orbiting scroll member 20 includes a baseplate 73, a spiral vane or wrap 74 projecting from an upper surface 76 of the baseplate 73, and an inner hub 78 projecting from a lower surface 80 of the baseplate 73. The inner hub 78 of the orbiting scroll member 20 may be directly and rotatably coupled the eccentric pin 56 of the driveshaft 16. Alternatively, the inner hub 78 may be rotatably coupled to the eccentric pin 56 via a bushing 82 and a bearing 83.

An Oldham coupling 84 is disposed generally between the orbiting scroll member 20 and the main bearing housing 18 and is keyed to the orbiting scroll member 20 and the main bearing housing 18. The Oldham coupling 84, in cooperation with the main bearing housing 18, restricts rotational motion between the non-orbiting scroll member 22 and the orbiting scroll member 20.

The non-orbiting scroll member 22 includes a baseplate 86 and a spiral vane or wrap 88 projecting from a lower surface 90 of the baseplate 86. The vane 88 of the non-orbiting scroll member 22 is in meshing engagement with the vane 74 of the orbiting scroll member 20. As the compressor 10 operates, the vane 88 of the non-orbiting scroll member 22 and the vane 74 of the orbiting scroll member 20 define moving, isolated crescent-shaped pockets of fluid. The fluid pockets carry the fluid to be handled from a low-pressure zone 92, in fluid communication with the inlet fitting 44, to a high-pressure zone 94, in fluid communication the discharge passage 96. In this regard, the fluid pockets may be referred to as compression pockets. The discharge passage 96 fluidly communicates with the interior volume 38 of the compressor 10, such that compressed fluid exits the shell 12 via the discharge passage 96 and discharge fitting 42. The non-orbiting scroll member 22 is designed to be mounted to the main bearing housing 18 using mechanical fasteners (not shown) such as threaded fasteners, bolts, screws, or a similar fastening device.

The compressor 10 may be referred to as a high side compressor since the discharge passage 96 fluidly communicates with the interior volume 38 of the compressor 10, and therefore the interior volume 38 is at a discharge gas pressure. However, in various implementations, the interior volume 38 may be in fluid communication with the inlet fitting 44 instead of the discharge passage 96, in which case the interior volume 38 is at a suction gas pressure. In these implementations, the compressor 10 may be referred to as a low side compressor.

The lubrication system 24 includes a lubricant passage 98 extending through the baseplate 73 of the orbiting scroll member 20, an inner circumferential groove 100 formed in a thrust surface 102 of the non-orbiting scroll member 22, an outer circumferential groove 104 formed in the thrust surface 102 of the non-orbiting scroll member 22, and a suction pocket 106 (FIG. 4) formed in the baseplate 86 of the non-orbiting scroll member 22. The central bore 60, the eccentric bore 64, and/or the lubricant supply area 70 may also be considered part of the lubrication system 24. The lubricant passage 98 delivers lubricant from the lubricant supply area 70 directly to the outer circumferential groove 104, the inner circumferential groove 100, and the suction pocket 106. In other words, lubricant exiting the lubricant passage 98 does not pass through another component, such as the main bearing housing 18 or the non-orbiting scroll member 22, before flowing to the outer circumferential groove 104, the inner circumferential groove 100, or the suction pocket 106.

Lubricant delivered to the inner and outer circumferential grooves 100 and 104 lubricates the interface between the thrust surface 102 of the non-orbiting scroll member 22 and the portion of the upper surface 76 of the orbiting scroll member 20 that is disposed radially outboard of the vane 74. This portion of the upper surface 76 may be referred to as the anti-thrust surface of the orbiting scroll member 20. During operation of the compressor 10, the anti-thrust surface of the orbiting scroll member 20 contacts the thrust surface 102 of the non-orbiting scroll member 22. Thus, delivering lubricant to the interface between the anti-thrust and thrust surfaces on the orbiting and non-orbiting scroll members 20 and 22 prevents damage to these surfaces caused by the friction resulting from the scroll members 20, 22 rubbing together.

Lubricant delivered to the suction pocket 106 lubricates the interfaces between the vanes 74 and 88 of the orbiting and non-orbiting scroll members 20 and 22, respectively. During operation of the compressor 10, the vane 74 of the orbiting scroll member 20 contacts the vane 88 of the non-orbiting scroll member 22 as the orbiting scroll member 20 orbits relative to the non-orbiting scroll member 22. Thus, delivering lubricant to the suction pocket 106 prevents damage to the vanes 74, 88 caused by the friction resulting from the vanes 74, 88 rubbing together. Lubricant delivered to the suction pocket 106 also helps seal gaps at the interfaces between the vanes 74 and 88 of the orbiting and non-orbiting scroll members 20 and 22, respectively, thereby improving the performance of the compressor 10.

The lubricant passage 98 has an inlet end 108 in fluid communication with the lubricant supply area 70 and an outlet end 110 in selective fluid communication with the outer circumferential groove 104, the inner circumferential groove 100, and the suction pocket 106. The lubricant passage 98 includes a first axial channel 112, a second axial channel 114, and a radial channel 116. The first axial channel 112 extends axially from the inlet end 108 of the lubricant passage 98 to the radial channel 116. The radial channel 116 extends radially from the first axial channel 112 to the second axial channel 114. The second axial channel 114 extends axially from the radial channel 116 to the outlet end 110 of the lubricant passage 98.

As the orbiting scroll member 20 orbits relative to the non-orbiting scroll member 22, the second axial channel 114 is selectively aligned with each of the outer circumferential groove 104, the inner circumferential groove 100, and the suction pocket 106. When the second axial channel 114 is aligned with one of the outer circumferential groove 104, the inner circumferential groove 100, and the suction pocket 106, a pressure difference causes lubricant to be injected from the second axial channel 114 to the one of the outer circumferential groove 104, the inner circumferential groove 100, and the suction pocket 106 with which the second axial channel 114 is aligned. In this regard, the second axial channel 114 may be referred to as an injection port.

The pressure difference that causes lubricant to be injected from the second axial channel 114 is a difference between the discharge gas pressure in the lubricant supply area 70 and the suction gas pressure in the low-pressure zone 92. The outer circumferential groove 104, the inner circumferential groove 100, and the suction pocket 106 are in fluid communication with and/or disposed within the low-pressure zone 92. Therefore, lubricant flows from the lubricant supply area 70, through the lubricant passage 98, and to the outer circumferential groove 104, the inner circumferential groove 100, or the suction pocket 106 when the second axial channel 114 is aligned with one of these elements.

The radial channel 116 of the lubricant passage 98 may be formed by drilling a hole into a side surface 118 of the orbiting scroll member 20. Thus, a plug 120 may be inserted into the radial channel 116 and disposed radially outboard of the second axial channel 114. The plug 120 prevents lubricant from exiting the lubricant passage 98 through the side surface 118 of the orbiting scroll member 20. The plug 120 may be made of a metal (e.g., brass) and may be press fit into the lubricant passage 98 or secured within the lubricant passage using one or more fasteners (e.g., a set screw).

Figure 3:
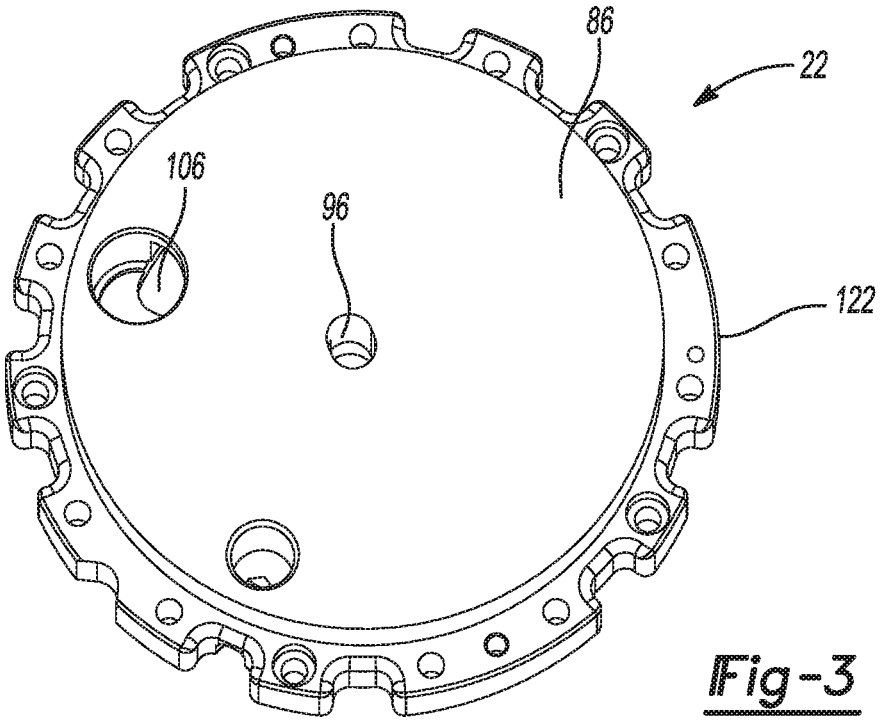
FIG. 3 is a top perspective view of the non-orbiting scroll member.
Figure 4:
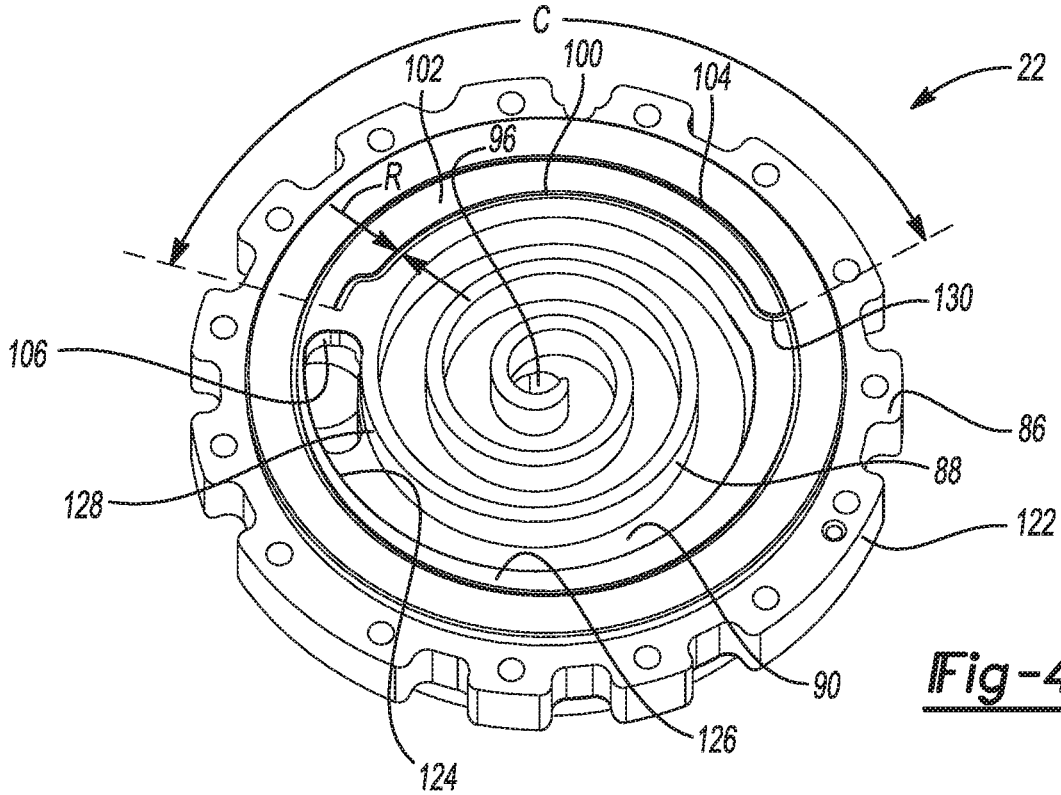
FIG. 4 is a bottom perspective view of the non-orbiting scroll member.

Referring to FIGS. 3 and 4, the baseplate 86 of the non-orbiting scroll member 22 has an outer radial surface 122 extending around the outer perimeter of the baseplate 86 and an inner radial surface 124 disposed radially inward of the outer radial surface 122. The inner radial surface 124 defines a pocket 126 in which the vane 88 is disposed. The thrust surface 102 of the non-orbiting scroll member 22 is disposed on the baseplate 86 between the inner and outer radial surfaces 122 and 124, and the thrust surface 102 faces the orbiting scroll member 20. The suction pocket 106 is disposed between and at least partially formed by the inner radial surface 124 of the baseplate 86 and an outermost radial surface 128 of the vane 88. The suction pocket 106 extends axially through the baseplate 86.

The outer circumferential groove 104 extends completely around a circumference of the non-orbiting scroll member 22 (e.g., a circumference of the non-orbiting scroll member 22 disposed just radially outward of the suction pocket 106). The inner circumferential groove 100 is disposed radially inward of the outer circumferential groove 104 and extends around at least one-third of a circumference of the non-orbiting scroll member 22 (e.g., a circumference of the non-orbiting scroll member 22 disposed just radially inward of the suction pocket 106). In the example shown, the inner circumferential groove 100 extends around nearly one-half of the circumference of the non-orbiting scroll member 22. The inner circumferential groove 100 includes a connection portion 130 that extends radially outward and intersects the outer circumferential groove 104. The connection portion 130 places the inner and outer circumferential grooves 100 and 104 in fluid communication with each other. In other embodiments, the inner circumferential groove 100 and/or the outer circumferential groove 104 may be in communication with the suction pocket 106 via a second connection portion (not shown).

The inner circumferential groove 100 has a radial dimension R, an axial dimension A (FIG. 2), and a circumferential dimension C that is greater than the radial dimension R and the axial dimension A. Although not separately labelled, the outer circumferential groove 104 also has a radial dimension, an axial dimension, and a circumferential dimension that is greater than the radial and axial dimensions of the outer circumferential groove 104. In the example shown, the radial and axial dimensions of the outer circumferential groove 104 are equal to the radial and axial dimensions R and A of the inner circumferential groove 100, respectively. In addition, the circumferential dimension of the outer circumferential groove 104 is greater than the circumferential dimension C of the inner circumferential groove 100. Although the radial and axial dimensions of the outer circumferential groove 104 are equal to the radial and axial dimensions R and A of the inner circumferential groove 100, respectively, in the example shown, it should be understood that this need not be the case. In other words, the radial, axial, and circumferential dimensions of the inner and outer circumferential grooves 100, 104 could be selected to yield any depth or shape desired to provide lubricant to the thrust and anti-thrust surfaces.

Figure 5:
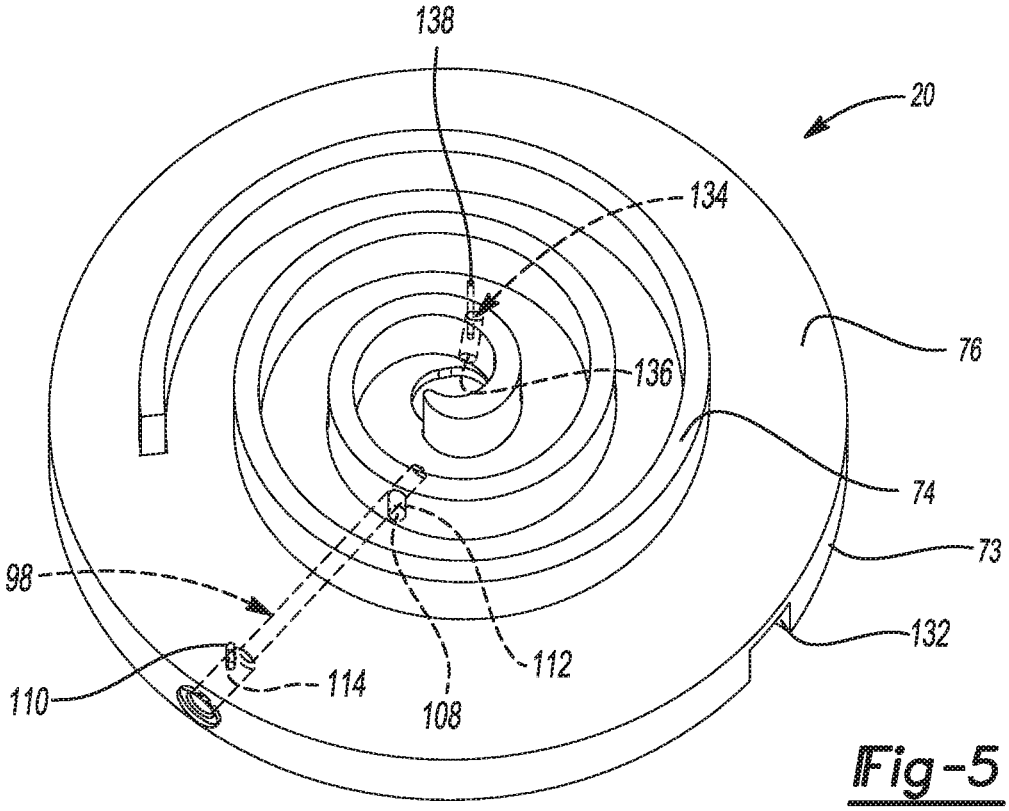
FIG. 5 is a top perspective view of the orbiting scroll member.
Figure 6:
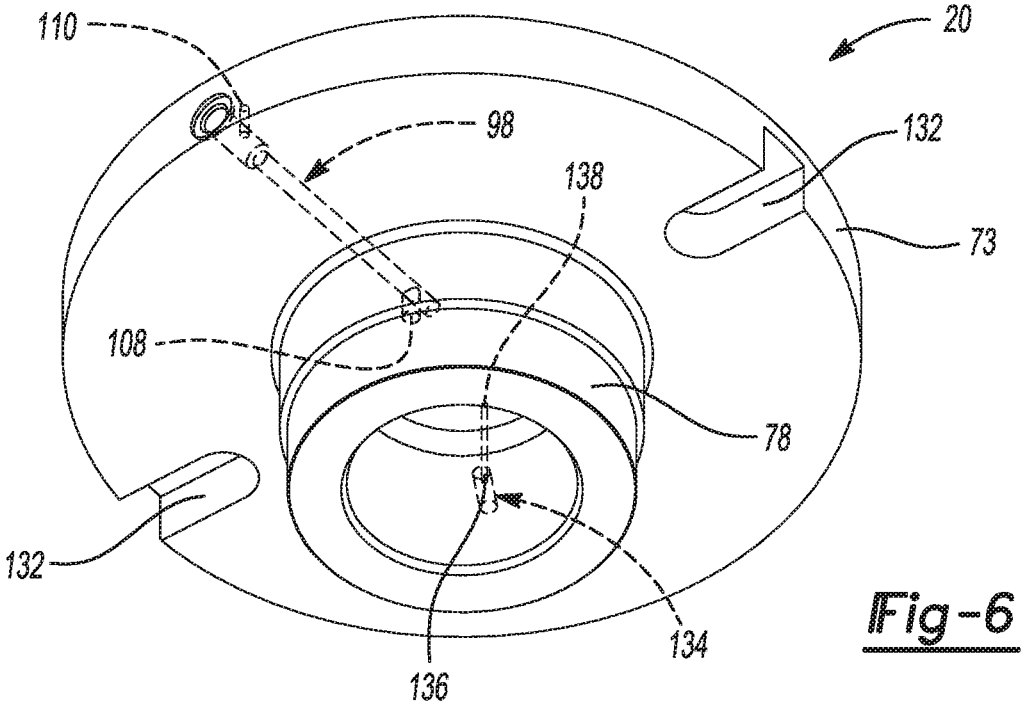
FIG. 6 is a bottom perspective view of the orbiting scroll member.
Figure 7:
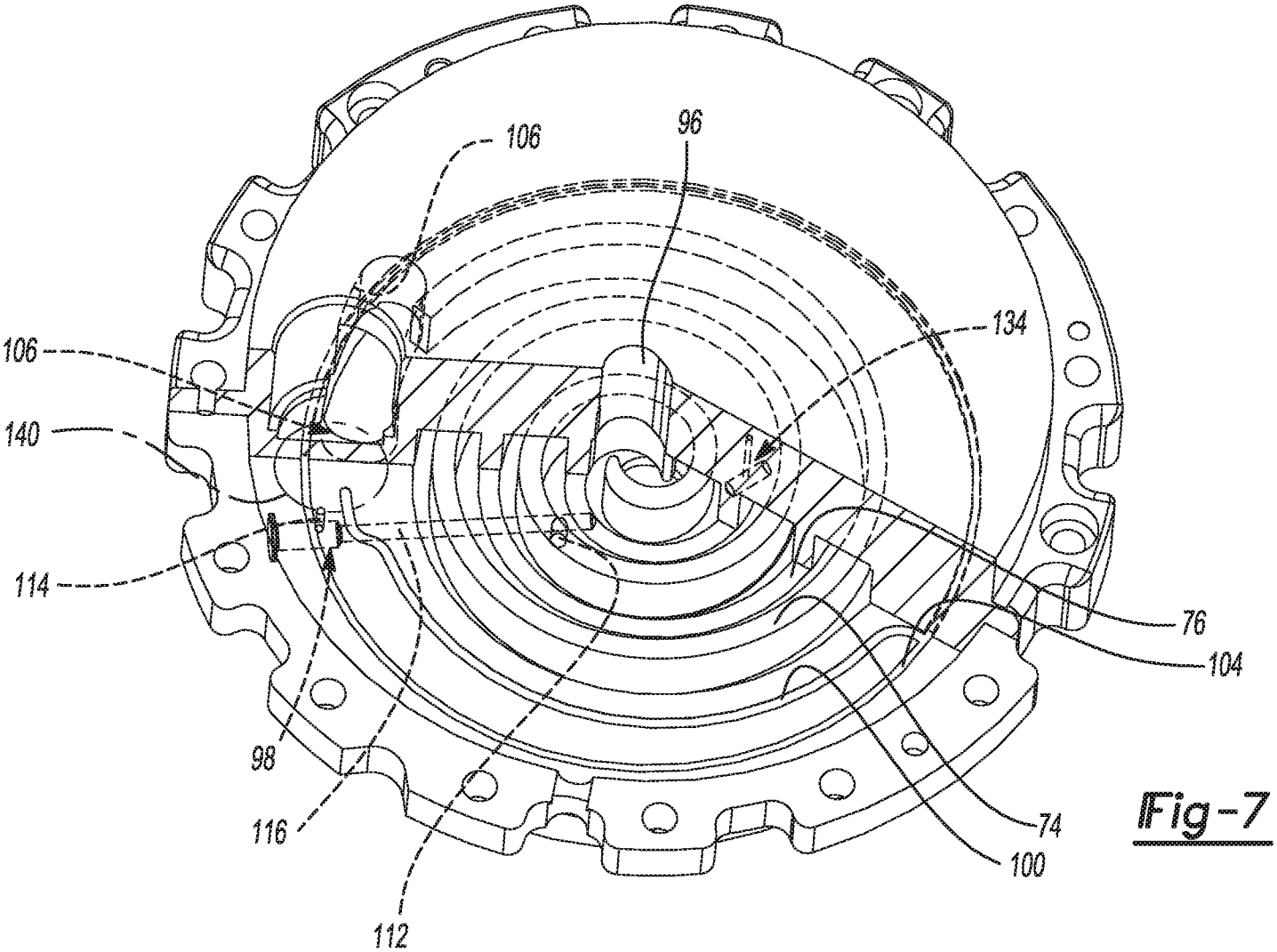
FIG. 7 is a sectioned perspective view of the non-orbiting and orbiting scroll members with a portion of the non-orbiting scroll member removed to illustrate features of the non-orbiting and orbiting scroll members that would otherwise be hidden.

Referring now to FIGS. 2, 5, and 6, the orbiting scroll member 20 further includes a pair of slots 132 and an intermediate passage 134. The Oldham coupling 84 is at least partially disposed within the slots 132 and is keyed to the orbiting scroll member 20 via the slots 132. The slots 132 allow the orbiting scroll member 20 to move radially relative to the Oldham coupling 84 and the non-orbiting scroll member 22 while preventing the orbiting scroll member 20 from rotating relative to the Oldham coupling 84 and the non-orbiting scroll member 22 in cooperation with the main bearing housing 18.

The intermediate passage 134 has a first end 136 in fluid communication with the intermediate chamber 71 and a second end 138 in fluid communication with the fluid pockets formed between the vanes 74, 88. The second end 138 is in fluid communication with the fluid pockets formed between the vanes 74, 88 at a location that is radially outward of the discharge passage 96 and radially inward of the suction pocket 106. Thus, the intermediate passage 134 places the intermediate chamber 71 in fluid communication with working fluid at an intermediate pressure that is less than the discharge gas pressure and greater than the suction gas pressure.

Figure 8:
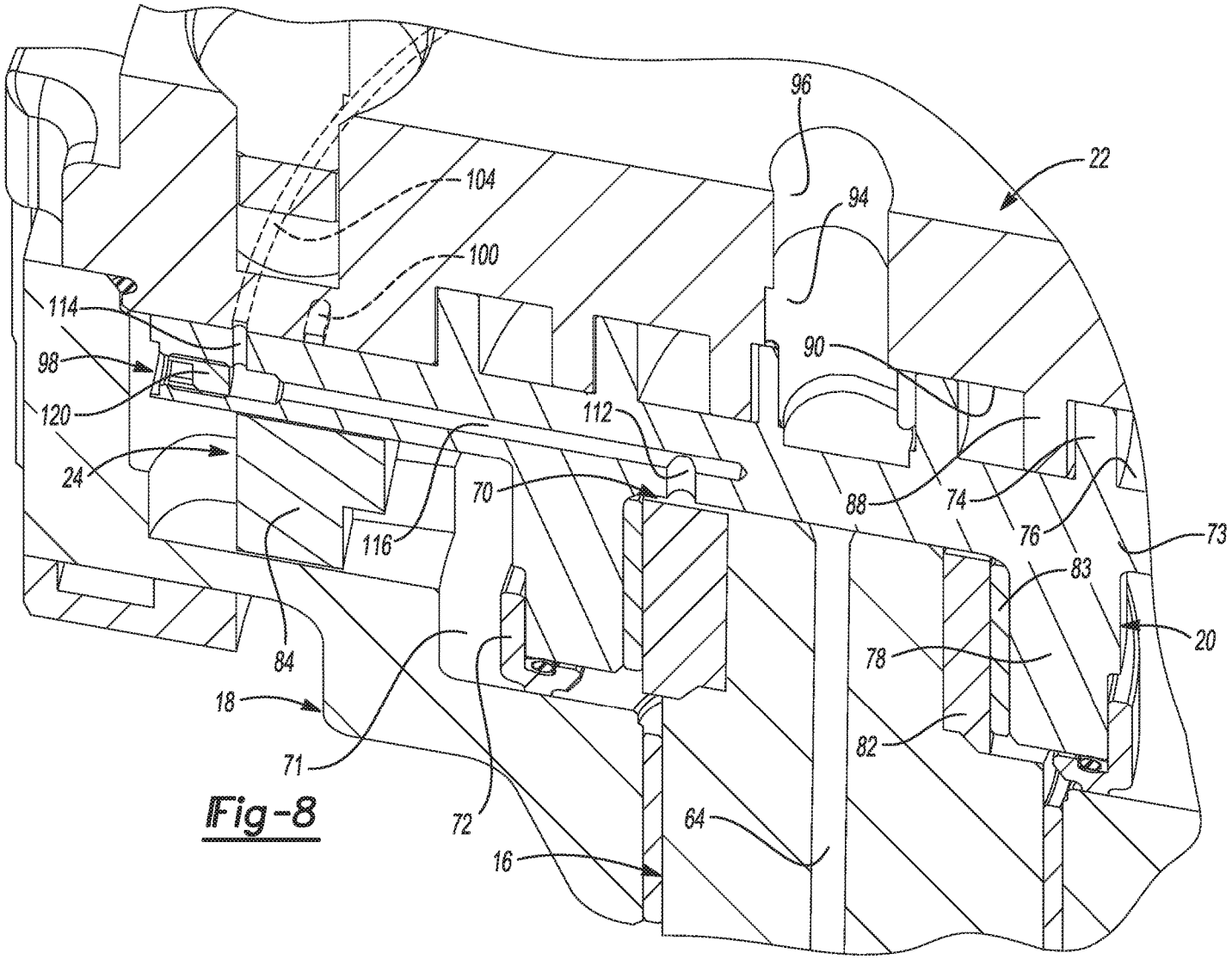
FIG. 8 is a sectioned perspective view of the oil management system of FIG. 2 with the orbiting scroll member shown in a first position.
Figure 9:
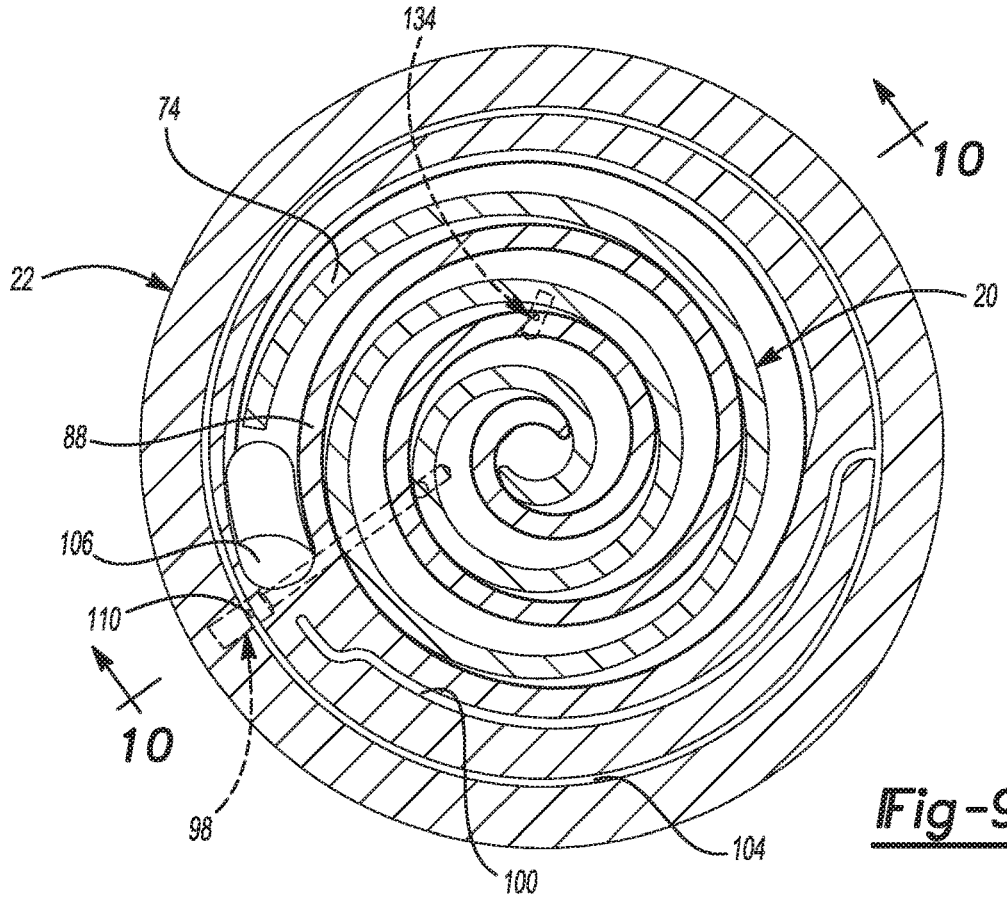
FIG. 9 is a sectioned top view of the oil management system of FIG. 2 with the orbiting scroll member shown in the first position and a lubricant passage in the orbiting scroll member shown using dashed lines.
Figure 10:
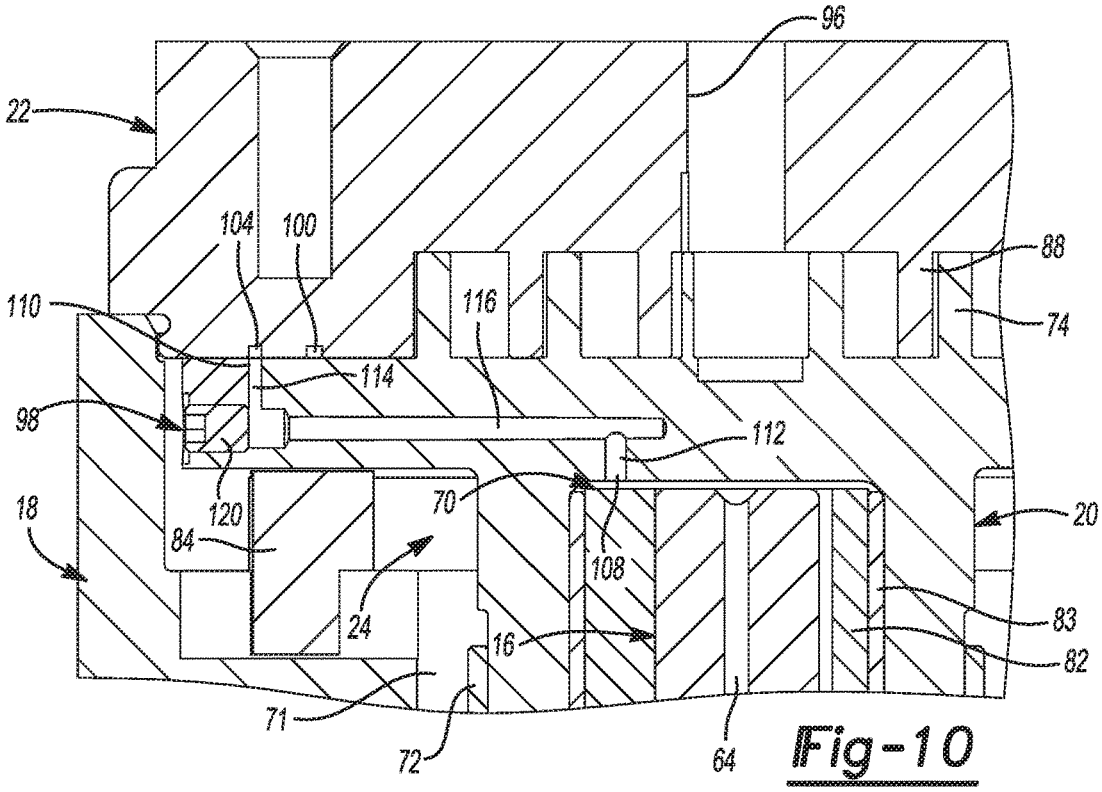
FIG. 10 is a cross-sectional view taken along line 10-10 shown in FIG. 9.

Referring now to FIGS. 7 through 14, operation of the lubrication system 24 will now be described in greater detail. As the orbiting scroll member 20 orbits relative to the non-orbiting scroll member 22, the second axial channel 114 of the lubricant passage 98 travels through an orbiting path 140. In FIGS. 8 through 10, the second axial channel 114 (or the outlet end 110 of the lubricant passage 98) is in a first position along the orbiting path 140. When the second axial channel 114 is in the first position, the second axial channel 114 is in fluid communication with the outer circumferential groove 104 in the non-orbiting scroll member 22. Thus, lubricant flows from the lubricant supply area 70, through the lubricant passage 98, and to the outer circumferential groove 104. In turn, lubricant in the outer circumferential groove 104 lubricates the interface between the anti-thrust and thrust surfaces on the orbiting and non-orbiting scroll members 20 and 22.

Figure 11:
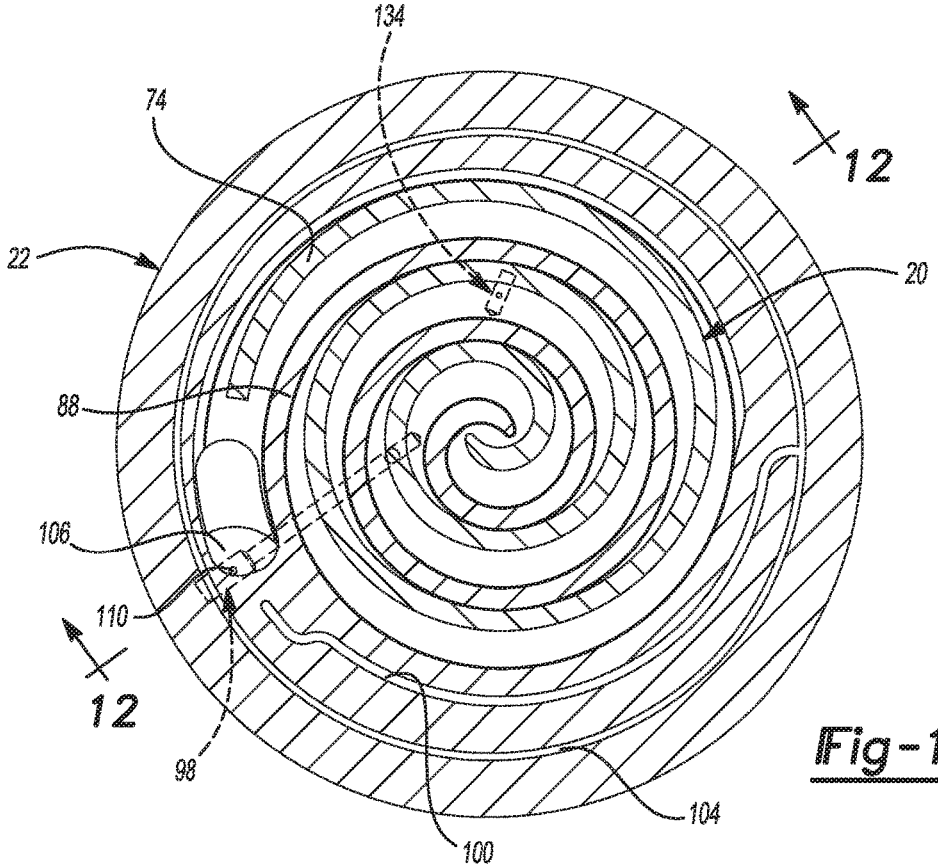
FIG. 11 is a sectioned top view of the oil management system of FIG. 2 with the orbiting scroll member shown in a second position and the lubricant passage in the orbiting scroll member shown using dashed lines.
Figure 12:
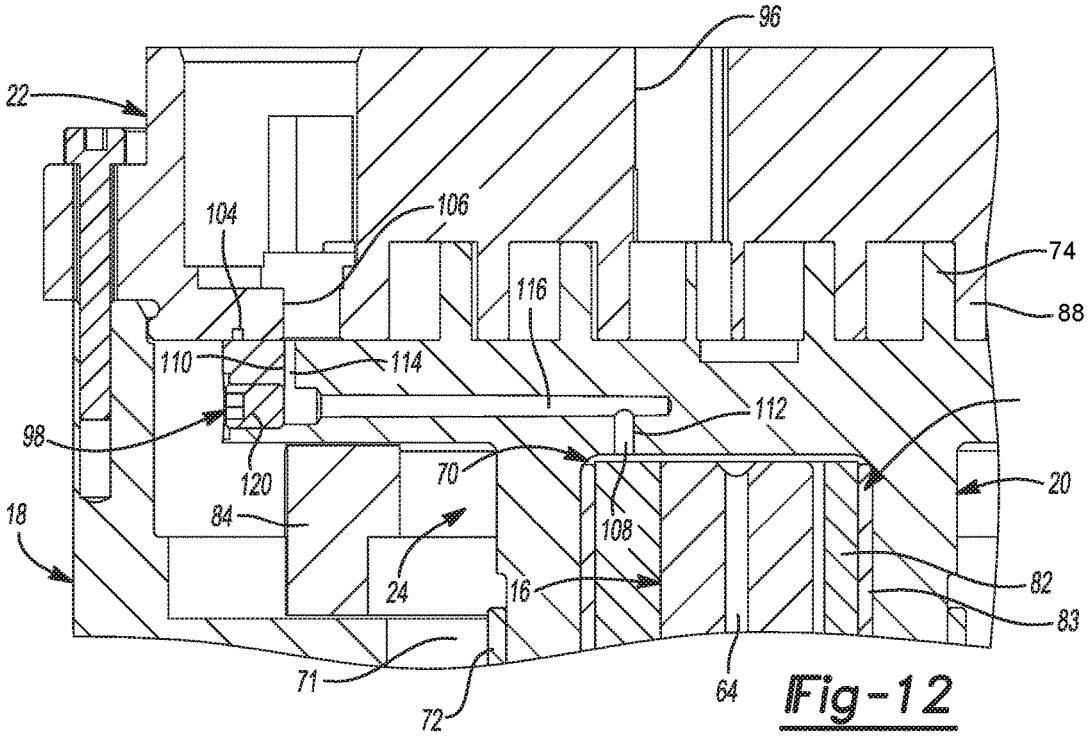
FIG. 12 is a cross-sectional view taken along line 12-12 shown in FIG. 11.

In FIGS. 11 and 12, the second axial channel 114 (or the outlet end 110 of the lubricant passage 98) is in a second position along the orbiting path 140. When the second axial channel 114 is in the second position, the second axial channel 114 is in fluid communication with the suction pocket 106 in the non-orbiting scroll member 22. Thus, lubricant flows from the lubricant supply area 70, through the lubricant passage 98, and to the suction pocket 106. In turn, lubricant in the suction pocket 106 lubricates the interfaces between the vanes 74 and 88 on the orbiting and non-orbiting scroll members 20 and 22, respectively. Lubricant delivered to the suction pocket 106 also helps seal gaps at the interfaces between the vanes 74 and 88 of the orbiting and non-orbiting scroll members 20 and 22, respectively, thereby improving the performance of the compressor 10.

Figure 13:
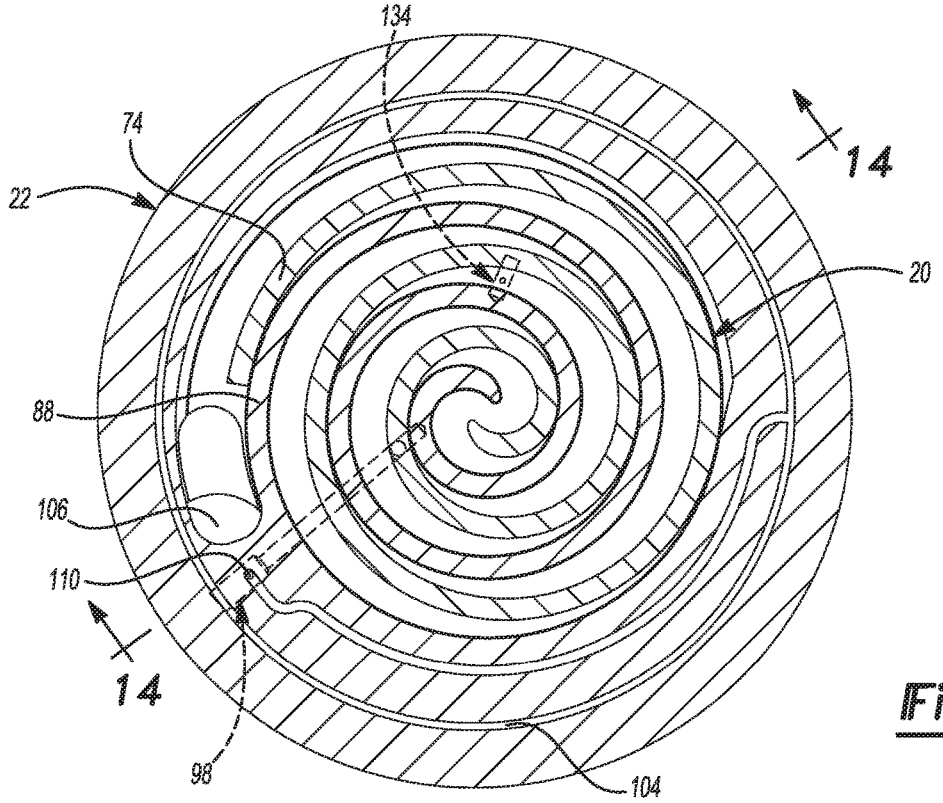
FIG. 13 is a sectioned top view of the oil management system of FIG. 2 with the orbiting scroll member shown in a third position and the lubricant passage in the orbiting scroll member shown using dashed lines.
Figure 14:
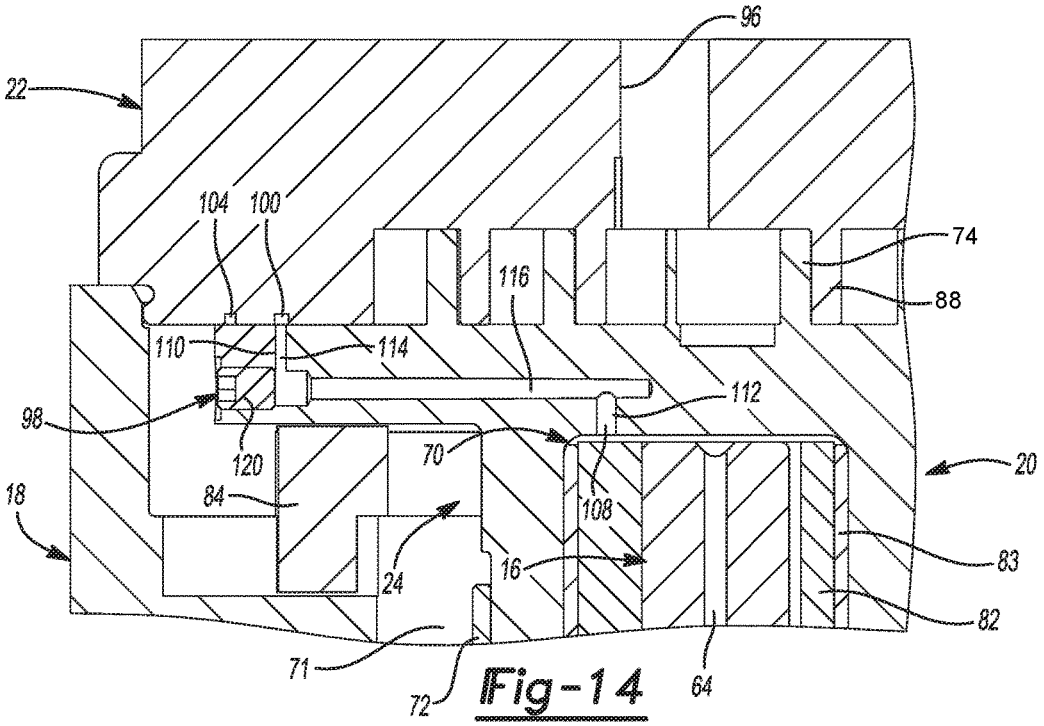
FIG. 14 is a cross-sectional view taken along line 14-14 shown in FIG. 9.

In FIGS. 13 and 14, the second axial channel 114 (or the outlet end 110 of the lubricant passage 98) is in a third position along the orbiting path 140. When the second axial channel 114 is in the third position, the second axial channel 114 is in fluid communication with the inner circumferential groove 100 in the non-orbiting scroll member 22. Thus, lubricant flows from the lubricant supply area 70, through the lubricant passage 98, and to the inner circumferential groove 100. In turn, lubricant in the inner circumferential groove 100 lubricates the interface between the anti-thrust and thrust surfaces on the orbiting and non-orbiting scroll members 20 and 22.

Thus, the lubricant passage 98 delivers lubricant to the interface between the anti-thrust and thrust surfaces on the orbiting and non-orbiting scroll members 20 and 22 and, via the suction pocket 106, to the meshing surfaces on the vanes 74 and 88 of the orbiting and non-orbiting scroll members 20 and 22. If too much lubricant is delivered to these interfaces, the performance of the compressor 10 may be degraded. If too little lubricant is delivered to these interfaces, the thrust and anti-thrust surfaces and the meshing vane surfaces may be damaged, which may shorten the life expectancy of the compressor 10.

The size and location of the lubricant passage 98 are each selected to ensure that the lubricant passage 98 delivers the proper amount of lubricant to the interface between the anti-thrust and thrust surfaces on the orbiting and non-orbiting scroll members 20 and 22 and to the meshing surfaces on the vanes 74 and 88 of the orbiting and non-orbiting scroll members 20 and 22. In this way, the lubrication system 24 prevents damage to the thrust and anti-thrust surfaces and the meshing vane surfaces without degrading the performance of the compressor 10. In one example, the diameter of the lubricant passage 98 may be selected to yield a desired amount of lubricant flow to the inner circumferential groove 100, the outer circumferential groove 104, and the suction pocket 106. The difference between the discharge gas pressure in the lubricant supply area 70 the suction gas pressure in the low-pressure zone 92 may also be considered when selecting the diameter of the lubricant passage 98. In another example, the location of the second axial channel 114 may be selected to ensure that the second axial channel 114 is aligned with each of inner circumferential groove 100, the outer circumferential groove 104, and the suction pocket 106, albeit at different times, as the orbiting scroll member 20 orbits relative to the non-orbiting scroll member 22.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed herein could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A compressor comprising:

a shell;

a main bearing housing disposed within the shell;

a driveshaft supported by the main bearing housing;

a non-orbiting scroll member coupled to the main bearing housing, the non-orbiting scroll member forming a suction pocket and at least one circumferential groove; and an orbiting scroll member rotatably coupled to the driveshaft and meshingly engaged with the non-orbiting scroll member, the orbiting scroll member forming a lubricant passage that delivers lubricant from a lubricant source directly to both the suction pocket and the at least one circumferential groove at different times.

2. The compressor of claim 1 wherein the lubricant passage in the orbiting scroll member includes an inlet end in fluid communication with the lubricant source and an outlet end in selective fluid communication with the suction pocket and the at least one circumferential groove in the non-orbiting scroll member.

3. The compressor of claim 2 wherein, as the orbiting scroll member orbits relative to the non-orbiting scroll member, the outlet end of the lubricant passage moves to a first position in which the outlet end is in fluid communication with the suction pocket and a second position in which the outlet end is in fluid communication with the at least one circumferential groove.

4. The compressor of claim 2 wherein the at least one circumferential groove includes an outer circumferential groove and an inner circumferential groove disposed radially inward of the outer circumferential groove, the outlet end of the lubricant passage being in selective fluid communication with the suction pocket, the outer circumferential groove, and the inner circumferential groove.

5. The compressor of claim 4 wherein, as the orbiting scroll member orbits relative to the non-orbiting scroll member, the outlet end of the lubricant passage moves to a first position in which the outlet end is in fluid communication with the suction pocket, a second position in which the outlet end is in fluid communication with the outer circumferential groove, and a third position in which the outlet end is in fluid communication with the inner circumferential groove.

6. The compressor of claim 2 wherein the lubricant passage includes a first axial channel, a second axial channel, and a radial channel, the first axial channel extending axially through the orbiting scroll member from the inlet end of the lubricant passage to the radial channel, the radial channel extending radially through the orbiting scroll member from the first axial channel to the second axial channel, the second axial channel extending axially through the orbiting scroll member from the radial channel to the outlet end of the lubricant passage.

7. The compressor of claim 1 wherein the orbiting scroll member includes a baseplate and a vane projecting axially from the baseplate, the lubricant passage extending through the baseplate of the orbiting scroll member to deliver the lubricant from the lubricant source directly to the at least one circumferential groove in the non-orbiting scroll member.

8. The compressor of claim 7 wherein the orbiting scroll member further includes a hub projecting from the baseplate in an opposite direction than the vane, the driveshaft having a first end disposed within the hub, a second end opposite of the first end, and an axial bore extending through the driveshaft from the second end to the first end, the lubricant source being the lubricant delivered through the axial bore in the driveshaft to a lubricant supply area disposed between the first end of the driveshaft and the hub.

9. The compressor of claim 7 wherein the non-orbiting scroll member includes a baseplate and a vane projecting axially from the baseplate of the non-orbiting scroll member, the vane of the orbiting scroll member meshingly engaging the vane of the non-orbiting scroll member to form a compression pocket, the at least one circumferential groove being disposed radially outward relative to the vane of the non-orbiting scroll member.

10. The compressor of claim 9 wherein the suction pocket places the compression pocket in fluid communication with a suction gas inlet fitting extending through the shell of the compressor.

11. The compressor of claim 1 wherein the lubricant passage in the orbiting scroll member delivers the lubricant from the lubricant source directly to the suction pocket, wherein the suction pocket is in fluid communication with a suction gas inlet fitting extending through the shell of the compressor.

12. The compressor of claim 1 wherein the at least one circumferential groove extends around at least one-third of the circumference of the non-orbiting scroll member.

13. The compressor of claim 1 wherein the at least one circumferential groove has a radial dimension in a radial direction of the non-orbiting scroll member, an axial dimension in an axial direction of the non-orbiting scroll member, and a circumferential dimension in a circumferential direction of the non-orbiting scroll member, the circumferential dimension being greater than the radial dimension and the axial dimension.

14. A compressor comprising:

a shell;

a main bearing housing disposed within the shell;

a driveshaft supported by the main bearing housing;

a non-orbiting scroll member coupled to the main bearing housing, the non-orbiting scroll member forming a suction pocket and at least one circumferential groove; and an orbiting scroll member rotatably coupled to the driveshaft and cooperating with the non-orbiting scroll member to form a compression pocket, the orbiting scroll member forming an injection port in fluid communication with a lubricant source, wherein as the orbiting scroll member orbits relative to the non-orbiting scroll member, the injection port moves to a first position in which the injection port delivers lubricant to the suction pocket and to a second position in which the injection port delivers the lubricant to the at least one circumferential groove.

15. The compressor of claim 14 wherein the injection port delivers the lubricant directly to the suction pocket when the injection port is in the first position.

16. The compressor of claim 14 wherein the injection port delivers the lubricant directly to the at least one circumferential groove when the injection port is in the second position.

17. The compressor of claim 14 wherein the at least one circumferential groove has a radial dimension in a radial direction of the non-orbiting scroll member, an axial dimension in an axial direction of the non-orbiting scroll member, and a circumferential dimension in a circumferential direction of the non-orbiting scroll member, the circumferential dimension being greater than the radial dimension and the axial dimension.

18. The compressor of claim 14 wherein the non-orbiting scroll member includes a baseplate and a vane projecting from the baseplate, the baseplate having an outer radial surface extending around an outer perimeter of the baseplate, an inner radial surface defining a pocket in which the vane is disposed, and a thrust surface disposed between the inner and outer radial surfaces and facing the orbiting scroll member, the at least one circumferential groove being formed in the thrust surface.

19. The compressor of claim 18 wherein the suction pocket is disposed between the inner radial surface of the baseplate and an outermost radial surface of the vane and extends axially through the baseplate.

20. The compressor of claim 18 wherein the suction pocket extends axially through the baseplate of the non-orbiting scroll member.

21. The compressor of claim 14 wherein the at least one circumferential groove includes an outer circumferential groove and an inner circumferential groove disposed radially inward of the outer circumferential groove, the injection port delivering the lubricant directly to the outer circumferential groove when the injection port is in the second position, the injection port moving to a third position as the orbiting scroll member orbits relative to the non-orbiting scroll member, the injection port delivering the lubricant directly to the inner circumferential groove when the injection port is in the third position.

22. The compressor of claim 21 wherein the outer circumferential groove extends completely around a circumference of the non-orbiting scroll member.

23. The compressor of claim 22 wherein the inner circumferential groove extends around at least one-third of the circumference of the non-orbiting scroll member and includes a connection portion that extends radially outward and intersects the outer circumferential groove.

24. The compressor of claim 14 wherein the at least one circumferential groove extends around at least one-third of the circumference of the non-orbiting scroll member.

25. The compressor of claim 14 wherein the suction pocket places the compression pocket in fluid communication with a suction gas inlet fitting extending through the shell of the compressor.

* * * * *